United States Patent [19]

Sundholm

[11] Patent Number: 5,007,444

[45] Date of Patent: Apr. 16, 1991

[54] APPARATUS FOR FLUSHING SMALL-DIAMETER HYDRAULIC PIPE SYSTEMS AND THE LIKE

[76] Inventor: Göran Sundholm, Magistervägen 34 B, SF-02700 Grankulla, Finland

[21] Appl. No.: 326,542

[22] PCT Filed: Oct. 20, 1987

[86] PCT No.: PCT/FI87/00138

§ 371 Date: Feb. 28, 1989

§ 102(e) Date: Feb. 28, 1989

[87] PCT Pub. No.: WO88/03065

PCT Pub. Date: May 5, 1988

[30] Foreign Application Priority Data

Oct. 23, 1986 [FI] Finland ..... 864289
Jan. 12, 1987 [FI] Finland ..... 870102

[51] Int. Cl.[5] ..... B08B 3/10

[52] U.S. Cl. ..... 134/102; 134/166 C; 134/168 C; 134/169 C

[58] Field of Search ..... 134/22.12, 166 C, 168 C, 134/169 C, 102

[56] References Cited

U.S. PATENT DOCUMENTS

| | | | |
|---|---|---|---|
| 1,034,301 | 7/1912 | Redeker | 134/22.12 X |
| 1,628,530 | 5/1927 | Burnett | 134/22.12 |
| 2,222,516 | 11/1940 | Powell et al. | 134/22.12 X |
| 2,289,351 | 7/1942 | Dixon et al. | 134/22.12 X |
| 2,935,429 | 5/1960 | Grotlisch | 134/22.12 |
| 3,409,470 | 11/1968 | Karpovich | 134/22.12 |
| 4,419,141 | 12/1983 | Kunkel | 134/22.12 |
| 4,645,542 | 2/1987 | Scharton et al. | 134/22.12 X |
| 4,655,846 | 4/1987 | Scharton et al. | 134/22.12 X |

FOREIGN PATENT DOCUMENTS

| | | | |
|---|---|---|---|
| 235702 | 9/1961 | Australia | 134/22.12 |
| 597443 | 3/1975 | U.S.S.R. | 134/22.12 |
| 597439 | 3/1978 | U.S.S.R. | 134/22.12 |
| 931243 | 5/1982 | U.S.S.R. | 134/22.12 |
| 1062311 | 12/1983 | U.S.S.R. | 134/22.12 |

*Primary Examiner*—Frankie L. Stinson
*Attorney, Agent, or Firm*—Ladas & Parry

[57] ABSTRACT

The invention relates to an apparatus for flushing a hydraulic small-diameter pipe system or the like. Two pressure accumulators (33*a* and 33*b*) are arranged at one end of the pipe system (20), connectable alternately to the pipe system and to a tank (39), for receiving a volume of liquid corresponding to volumes of gas and liquid, respectively, which are alternately introduced into the opposite end of the pipe systems for filling the pipe system with alternating columns (42, 43) of flushing liquid and compressed gas, and on achieving a predetermined pressure in the pipe system, the pipe system is opened into a receiving tank, whereby the compressed gas is suddenly expanded and drives a forceful flushing pulse through the pipe system.

8 Claims, 2 Drawing Sheets

APPARATUS FOR FLUSHING SMALL-DIAMETER HYDRAULIC PIPE SYSTEMS AND THE LIKE

Figure 1:
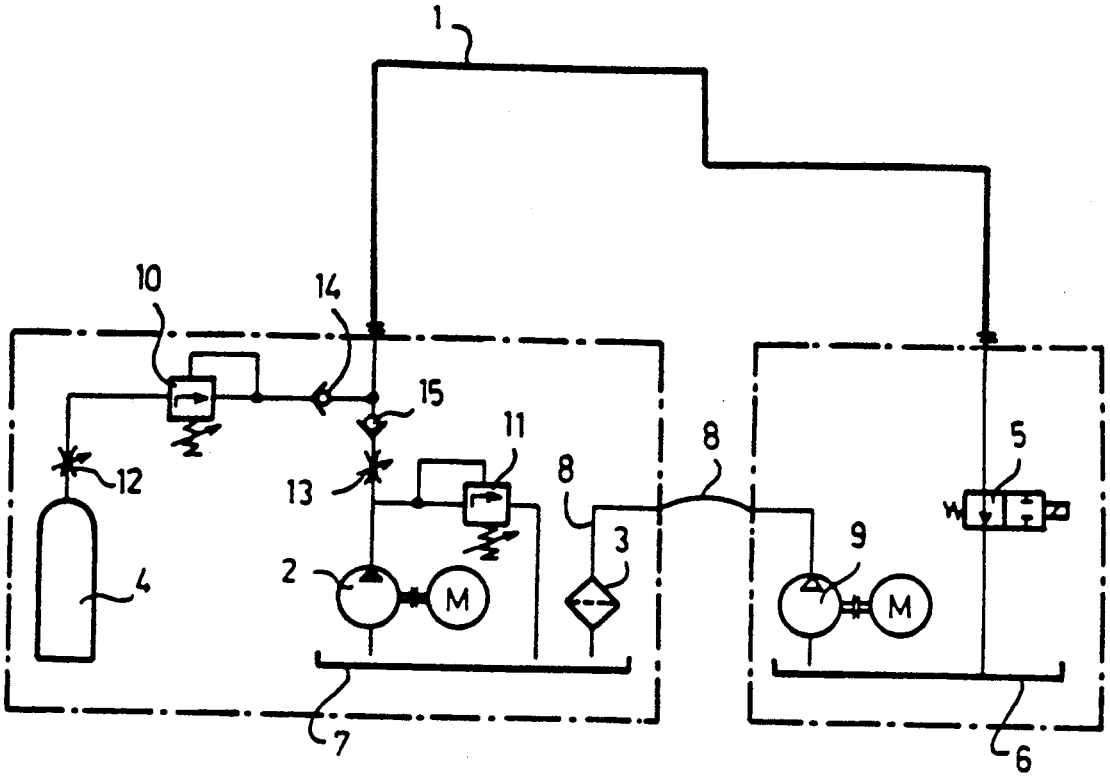

The present invention relates to an apparatus for flushing hydraulic small-diameter pipe systems and the like or a part of such a pipe system, comprising a hydraulic pump means for flushing liquid through the pipe system, and filter means.

Hydraulic and other similar pipe systems ought to be cleaned internally, before the system is taken into use, to remove contaminating particles remaining after the manufacture and mounting, since these otherwise will later on cause serious disturbances during operation.

It is a generally accepted opinion among those skilled in the art that for achieving sufficiently good results the flushing has to be carried out with a flow volume sufficiently large to create a turbulent flow, i.e. it is necessary to obtain a value of about 4,000 on the Reynolds's scale.

With long small-diameter pipe systems, it has not previously been possible to achieve a sufficiently efficient flushing. Pipe systems for valve control hydraulics in a ship may be mentioned as an example. The length of the pipe system may well amount to about 200 m, the pipe diameter is about 10 mm, and oil with a viscosity of e.g. 37 cSt is used as a flushing liquid. In order to achieve a turbulent flow during the flushing, i.e. a value of about 4,000 on the Reynolds's scale, a flow of about 70 litres per minute is required, whereby the pressure drop will be about 4 bar per metre and from one end of the pipe system to the other about 800 bar. The problem is that this kind of pipes simply do not withstand such high pressures.

If the flushing is carried out with a smaller volume flow so as to keep the pressure drop in compliance with the pressure resistance properties of the pipe system, a laminar flow with practically non-existing cleaning properties is achieved in place of a turbulent flow. For this reason, the flushing has in most cases been totally neglected, which has resulted in serious subsequent operational disturbances.

The object of the present invention is to provide a new apparatus which enables hydraulic and other similar small-diameter pipe systems to be flushed efficiently.

The apparatus according to the invention is mainly characterized in that means for feeding a pressurized gas into the flushing liquid are arranged in connection with the hydraulic pump means, and that the flushing circuit includes valve means arranged to at first be closed when the pipe system has been filed with flushing liquid and said pressurized gas, in order to compress the gas entrained in the pipe system, and thereafter to be opened for expanding the gas, in order to create a forceful flushing pulse through the pipe system.

In a preferred embodiment of the invention, the entire pipe system is at first filled with flushing liquid, preferably oil, whereafter gas and further oil are alternately introduced pulsewise into the pipe system, at least one liquid pressure accumulator being provided at the outlet end of the pipe system to receive a volume of oil corresponding to the introduced volume of said gas and further oil, respectively, and to therebetween be emptied into an oil receiver tank. When the pipe system has been substantially filled with alternating gas and oil columns, and compressed the pipe system is opened into the receiver tank, whereat a forceful flushing pulse through the pipe system, preferably in a direction opposite to the pulsewise filling.

The entrained gas is preferably nitrogen. The impurities flushed out are filtered off the flushing liquid in a filter aggregate preferably arranged in a return pump conduit between a collecting tank at the outlet end of pipe system and the tank of the hydraulic pump means. This is because the filter aggregate does not resist the forceful liquid pulses.

Figure 2:
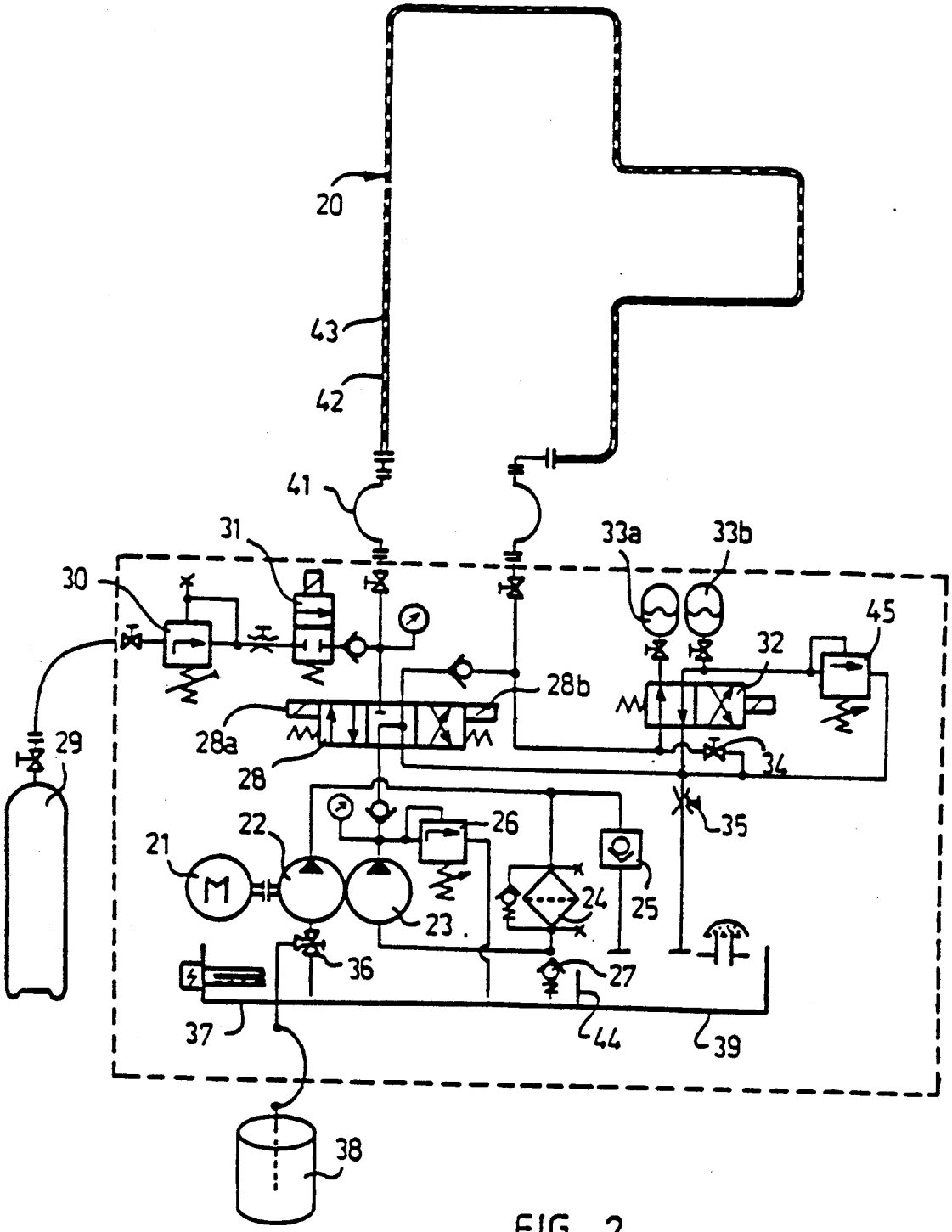

In the following the invention will be described in more detail with reference to the attached drawing, in which FIGS. 1 and 2 show schematically two embodiments in the form of coupling diagrams.

In FIG. 1, the pipe system to be cleaned is designated with the reference numeral 1. The numeral 2 designates a pump means for the flushing liquid, generally oil; 3 designates a filter aggregate; 4 designates a container for gas, preferably nitrogen; 5 designates a shut-off valve which can be opened and closed intermittently; 6 designates a tank for collecting the flushing liquid after the shut-off valve 5; 7 designates a tank of the pump 2; 8 designates a connecting conduit from the collecting tank 6 to the pump tank 7; 9 designates a pump for transporting the flushing liquid collected in the tank 6 to the tank 7; 10 and 11 designate a pressure regulating valve and a pressure relief valve; 12 and 13 designate flow regulating valves; 14 and 15 designate non-return valves.

The flushing is carried out in the following way:

At first, the shut-off valve 5 is kept open as shown in the drawing, whereby the pipe system 1 is filled simultaneously with flushing liquid from the pump 2 and with gas, preferably nitrogen, from the container 4.

When the pipe system has been filled up, the valve 5 is closed and the pressure rises in the pipe system to a value set for the pressure regulating valve 11, e.g. 50 bar, whereby the non-return valve 14 in the outlet conduit of the gas container 4 is closed and the gas entrained by the flushing liquid is compressed within the entire pipe system 1.

When the limit pressure of the valve 11 is reached, the shut-off valve 5 is opened, whereby the sudden pressure drop in the pipe system 1 causes the gas compressed in the flushing liquid to be expanded forcefully so that the pipe system 1 is emptied rapidly by a forceful flow pulse which effectively loosens the impurities on the inner walls of the pipe system. After the flow pulse has weakened, the valve 5 is again closed, and the flushing is continued in the same way until the required cleanness of the pipe system has been achieved.

The operation of the shut-off valve 5 may be e.g. time-based or simply based on the sensing of the pressure in the pipe system 1; one skilled in the art will not encounter any problems in effecting the flushing process by means of commercially available equipment.

In FIG. 2, the pipe system to be cleaned is designated with the reference numeral 20. The reference numeral 21 designates a motor for two cooperating pumps 22 and 23 for the flushing liquid, generally oil. The reference numeral 24 designates a filter aggregate; 25 designates a valve for removing gas from the flushing liquid; 26 designates a pressure relief valve for the pump 23, in the present case set to 35 bar, for instance; 27 designates a non-return valve; **28*a* and 28*b* designate control valves for filling the pipe system with oil and, respectively, for emptying the pipe system during the flushing operation. 29 designates a container for gas, preferably nitrogen; 30 designates a pressure reducing valve for the gas, set to 12 bar, for instance; 31 designates a control valve for supplying gas to the pipe system 20; 32 designates a control valve for two parallel pressure accumulators 33***a* and 33*b*, both set to a counter pressure of 7 bar, for instance, and having a volume of e.g. 0.7 litres. 34 designates a conventional shut-off valve which is closed except for when the pipe system 20 is emptied after finalized flushing; 35 designates a valve for regulating the flushing flow rate; 36 designates a valve which connects the pump 22 either to an oil tank 37 or to filling from a barrel 38; and 39 designates a receiving tank for the flushing liquid. The oil conduit through the valve 35, to the tank 39 ends slightly above the surface of the liquid. 41 designates connecting hoses to and from the pipe system 20. 42 and 43 designate columns of gas and oil, respectively, 44 is a partition wall between the tanks 37 and 39, and 45 designates a pressure relief value set to e.g. 12 bar.

In addition to those mentioned above, typical values for the pipe system 20, for instance, are an inner diameter of 13 mm and a length of 200 m, or an inner diameter of 6 mm and a length of up to 1000 m; for the oil tank 200 1; for the pumps 22 and 23 about 12 and 10 1/minute, respectively; and for the motor 21 1.1 kW.

The apparatus operates in the following way:

When the motor 21 is running, the pump 22 pumps oil through the filter 24 to the pump 23, from where the oil is further passed back to the tank when the valve 28 is in center position, the situation in the drawing. As the capacity of the pump 22 is a little greater than the capacity of the pump 23, part of the greater than the capacity of the pump 23, part of the oil passes through the valve 27, and the degasifying valve 25 removes air and gas from the oil.

The flushing of the pipe system 20 is initiated by filling it with oil; the valve 28*b* is connected, to the left of the position in FIG. 3, so that oil flows into the pipe system. After the pipe system is full, the valve 28 is returned to center position.

The valve 32 is still in the position shown in FIG. 2, connecting the accumulator 33*a* to the pipe system 20 and the accumulator 33*b* to the tank 39. The valve 31 is opened and gas flows from the container 29 into the inlet end of the pipe system 20, to the left in FIG. 2, and the accumulator 33*a* receives a corresponding volume of oil. When the pressure in the accumulator 33*a* has reached the value determined by the valve 30, e.g. 12 bar, the valve 31 is closed. A short gas column 42 has been formed at the inlet end of the pipe system 20. The valve 28*a* is now connected, to the right from the position in FIG. 2, and the valve 32 is shifted to the left from the position in FIG. 2 to empty the accumulator 33*a* to the tank 39 and to connect the accumulator 33*b* to the pipe system 20. Oil flows into the inlet end of the pipe system 20 and a corresponding amount of oil is received by the accumulator 33*b*, until the pressure reaches the value set by the pressure regulating valve 45, e.g. 12 bar. There is now an oil column 43 after the afore-mentioned gas column 42 at the inlet end of the pipe system 20. The membranes of the pressure accumulators 33*a* and 33*b* yield as the pre-charged gas in the accumulators is compressed, the accumulators receive a volume corresponding to the difference between the pressure of the respective medium fed into the inlet of the system 20 and the pre-charged counter-pressure of the accumulators, setting the above-mentioned pressures.

The pulsewise filling of the pipe system alternately with gas and oil is continued in this way preferably until the system is substantially filled with alternating short gas columns 42 and oil columns 43, as shown in the drawing.

Thereafter the pressure in the pipe system 20 is raised to the set value of the regulating valve 26, e.g. 35 bar, to further compress the gas entrained in the pipe system 20. The valve 28*a* is connected and the valve 32 is in the position shown in FIG. 2.

Upon reaching the set pressure of e.g. 35 bar, the valve 28*b* is connected, to the left from the position in the drawing, so that the pipe system communicates openly with the receiving tank 39, and the mixture of oil and gas contained in the pipe system is emptied rapidly in a forceful flow pulse in a direction opposite to the pulsewise filling. The pipe system is preferably flushed with oil for a while, whereafter a new pulsewise filling is initiated. The flushing process continues in this way until the pipe system is clean. The pipe system is emptied by means of gas, whereby the valve 34 and the valve 31 are opened so that the oil flows into the tank 39.

Impurities are loosened partly during the pulsewise filling of the pipe system with gas and liquid and partly during the forceful emptying of the pipe system. The cleaning is made even more effective by carrying out the filling and respectively the emptying of the pipe system in opposite directions. By alternately filling the pipe system with short gas columns and short liquid columns, it is possible to avoid problems which arise in the metering of the amounts and the pressures of oil and gas, respectively, when gas and oil are fed simultaneously into the pipe system. Conditions for obtaining an efficient mixing of oil and gas when they are fed simultaneously into the pipe system vary considerably depending on the dimensions of the pipe system; moreover, they are difficult to determine in advance.

The flushing time depends on the diameter and length of the pipe system as well as on the amount of impurities. Guidance is easily obtainable through experience. The same applies to the operation of the various valves which may be e.g. time-based or simply based on the sensing of the pressure in the pipe system 20; one skilled in the art will not encounter any problems in effecting the flushing process by means of any commercially available equipment.

The impurities flushed out of the pipe system have to be filtered off the flushing liquid. Existing filter aggregates do not obviously withstand the occurring forceful liquid pulses, wherefore the filter aggregate should not be placed in direct connection with the pipe system. The forceful pulses of the flushing liquid are preferably collected in a tank 6 and 39, respectively, arranged for the purpose, wherefrom the flushing liquid is pumped into a tank 7 and 37, respectively, for the flushing pump 2, through a separate conduit 8, FIG. 1; or it is allowed to flow over a partition wall 44 into the tank 37 as shown in FIG. 2. The flow through the filter aggregate included in a separate circuit can thus be maintained on an even, relatively low level.

In the drawing, the inlet and outlet ends of the pipe systems 1 and 20, respectively, are situated close to each other. If the inlet and outlet ends of the pipe system are far apart, it may be preferable to have one flushing apparatus at each end and to flush the pipe of FIG. 1, the conduit 8 would lead from the motor 9 to the tank 7 of the other motor aggregate at the outlet end of the pipe system and an additional valve 5, with a receiver tank and filtering means would be provided at the inlet end of the pipe system. The apparatus according to FIG. 2 would be divided in a similar manner.

I claim:

1. An apparatus for flushing at least a portion of a hydraulic pipe system, comprising a hydraulic pump means for flushing a liquid through the pipe system, and filter means together forming a flushing circuit comprising:

means for coupling a flushing circuit to a pipe system;

means for feeding a gas into the flushing liquid arranged in combination with the hydraulic pump means, and the flushing circuit including valve means arranged to at first be closed when the pipe system has been filled with flushing liquid and gas, means for compressing the gas entrained in the pipe system, and said valve means thereafter being opened for expanding the compressed gas, in order to create a forceful flushing pulse through the pipe system.

2. An apparatus according to claim 1 wherein the flushing circuit includes means for filling the pipe system alternately with columns of gas and liquid.

3. An apparatus according to claim 2, wherein the means for filling the pipe system with gas and liquid comprise at least one pressure liquid accumulator connectable to the pipe system to receive an amount of liquid corresponding to the volume of gas and liquid, respectively, alternately fed into the pipe system, and arranged to be emptied into a receiving tank.

4. An apparatus according to claim 3, wherein it comprises two pressure liquid accumulators arranged to be alternately connected to the pipe system and, respectively, emptied to the receiving tank.

5. An apparatus according to claim 2, wherein the valve means is arranged to lead the forceful flow pulse through the pipe system in a direction opposite to the periodical alternate filling of the pipe system with gas and liquid, respectively.

6. An apparatus according to claim 1, wherein a tank is arranged after the valve means, for collecting the flushing liquid, that said collecting tank is connected to a tank of the hydraulic pump means through a pump conduit, and that a filter of the apparatus is arranged in said pump conduit.

7. An apparatus according to claim 1 wherein said valve means is at an outlet end of said pipe system.

8. An apparatus according to claim 1, wherein said gas entrained said pipe system is compresses by said hydraulic pump means.

* * * * *